US009666970B2

(12) United States Patent
Kida

(10) Patent No.: US 9,666,970 B2
(45) Date of Patent: May 30, 2017

(54) CONNECTOR

(71) Applicant: YAZAKI CORPORATION, Tokyo (JP)

(72) Inventor: Kousuke Kida, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/248,809

(22) Filed: Aug. 26, 2016

(65) Prior Publication Data

US 2017/0025780 A1 Jan. 26, 2017

Related U.S. Application Data

(63) Continuation of application No. PCT/JP2015/058630, filed on Mar. 20, 2015.

(30) Foreign Application Priority Data

Mar. 31, 2014 (JP) ..... 2014-072815

(51) Int. Cl.
*H01R 13/627* (2006.01)
*H01R 13/436* (2006.01)
(Continued)

(52) U.S. Cl.
CPC ..... *H01R 13/4362* (2013.01); *H01R 13/50* (2013.01); *H01R 13/5219* (2013.01); *H01R 2103/00* (2013.01)

(58) Field of Classification Search
CPC H01R 13/4362; H01R 13/50; H01R 13/5219; H01R 2103/00
(Continued)

(56) References Cited

U.S. PATENT DOCUMENTS 5,137,466 A * 8/1992 Endo ..... H01R 13/627 439/353
5,711,684 A * 1/1998 Inoue ..... H01R 13/6272 439/354
(Continued)

FOREIGN PATENT DOCUMENTS

JP 2009-43519 A 2/2009
JP 2009-76234 A 4/2009
JP 2010-73375 A 4/2010

OTHER PUBLICATIONS

International Search Report and Written Opinion of the International Search Report for PCT/JP2015/058630 dated Apr. 28, 2015.
(Continued)

*Primary Examiner* — Abdullah Riyami
*Assistant Examiner* — Nelson R Burgos-Guntin
(74) *Attorney, Agent, or Firm* — Kenealy Vaidya LLP

(57) ABSTRACT

A connector includes: a first connector housing which allows a second connector housing to be fitted in a fitting direction; and a retainer which is inserted, in an insertion direction perpendicular to the fitting direction, into the first connector housing, and which includes: a housing lock arm engaged with a lock protrusion provided in the first connector housing to position the retainer in a temporary lock position and a regular lock position when the retainer is inserted into the first connector housing; and a terminal lock portion engaged with a terminal metal fitting provided in the first connector housing to prevent the terminal metal fitting from dropping off when the retainer is positioned in the regular lock position. The retainer includes an arm support portion which supports both ends of the housing lock arm extending in the insertion direction.

3 Claims, 11 Drawing Sheets

(51) Int. Cl.
*H01R 13/52* (2006.01)
*H01R 13/50* (2006.01)
*H01R 103/00* (2006.01)

(58) Field of Classification Search
USPC ..... 439/752, 357, 358
See application file for complete search history.

(56) References Cited

U.S. PATENT DOCUMENTS 5,830,013 A * 11/1998 Saito ..... H01R 13/4362 439/595
6,533,600 B1 * 3/2003 Kashiyama ..... H01R 13/641 439/352
6,537,108 B2 * 3/2003 Sasaki ..... H01R 13/4364 439/595
6,860,750 B1 * 3/2005 Wu ..... H01R 13/6275 439/357
7,399,195 B2 * 7/2008 Kim ..... H01R 13/641 439/352
7,549,887 B1 * 6/2009 Ng ..... H01R 13/6272 439/352
7,909,638 B2 * 3/2011 Seo ..... H01R 13/6272 439/352
7,988,482 B2 * 8/2011 Kim ..... H01R 13/6599 439/357
7,988,502 B2 * 8/2011 Nagano ..... H01R 13/424 439/595
8,337,235 B2 * 12/2012 Mizutani ..... H01R 13/6272 439/352
9,017,111 B2 * 4/2015 Zheng ..... H01R 13/4223 439/595
2001/0046803 A1 * 11/2001 Kodama ..... H01R 13/6273 439/357
2005/0227548 A1 * 10/2005 Sian ..... H01R 13/424 439/752
2007/0224888 A1 * 9/2007 Tyler ..... H01R 13/4365 439/752
2008/0305672 A1 * 12/2008 Kodama ..... H01R 13/6273 439/357
2009/0149054 A1 * 6/2009 Zheng ..... H01R 13/641 439/357
2010/0068911 A1 * 3/2010 Nagano ..... H01R 13/424 439/345
2011/0244706 A1 * 10/2011 Rohde ..... H01R 13/6272 439/357
2014/0179146 A1 * 6/2014 Hamai ..... H01R 13/639 439/357
2015/0349449 A1 * 12/2015 Zhu ..... H01R 13/4368 439/752

OTHER PUBLICATIONS

International Preliminary Report on Patentability and English language Written Opinion of the International Search Report for PCT/JP2015/058630 dated Oct. 4, 2016.

* cited by examiner

CONNECTOR

CROSS REFERENCE TO RELATED APPLICATION(S)

This application is a continuation of PCT application No. PCT/JP2015/058630, which was filed on Mar. 20, 2015, based on Japanese Patent Application (No. 2014-072815) filed on Mar. 31, 2014, the contents of which are incorporated herein by reference.

BACKGROUND OF THE INVENTION

1. Field of the Invention

The present invention relates to a connector in which terminal metal fittings inside a connector housing are prevented from dropping off by a retainer inserted into the connector housing from one side surface of the connector housing.

2. Description of the Related Art

FIG. 10 and FIG. 11 show a connector disclosed in JP-A-2010-73375.

In the connector 100, terminal metal fittings inside a first connector housing 110 are prevented from dropping off by a retainer 200 which is inserted into the first connector housing 110 from one side surface 111 of the first connector housing 110.

The first connector housing 110 is an injection molded article made of a resin. As shown in FIG. 10, the first connector housing 110 includes a terminal receiving portion 120, a hood portion 130, and a lock arm 140. The terminal receiving portion 120 is substantially shaped like a column. The hood portion 130 has a cylindrical structure to surround the terminal receiving portion 120. The lock arm 140 is formed integrally with the terminal receiving portion 120.

The terminal receiving portion 120 is a region retaining the terminal metal fittings connected to electric line ends. The terminal receiving portion 120 is shaped like a column extending in a fitting direction (direction of an arrow Y1 in FIG. 10) to a partner connector housing. In the terminal receiving portion 120, a plurality of terminal receiving holes 121 receiving the terminal metal fittings are arranged at fixed intervals in one row in a connector width direction (direction of an arrow X1 which is a direction perpendicular to the fitting direction Y1 between the connector housings in FIG. 10). Each of the terminal receiving holes 121 extends in the fitting direction Y1 to the partner connector housing.

In addition, the terminal receiving portion 120 includes a retainer inserting portion 123, a temporary lock portion, and a regular lock portion. Temporary lock lances 220 or terminal lock portions 230 of the retainer 200 which will be described later are inserted through the retainer inserting portion 123. The temporary lock portion locks the retainer 200 in a temporary lock position. The regular lock portion locks the retainer 200 in a regular lock position.

The hood portion 130 is a region which is fitted to an outer circumference of a cylindrical portion of the partner connector housing. As shown in FIG. 10, the hood portion 130 defines a gap 151 surrounding the terminal receiving portion 120 so that the cylindrical portion of the partner connector housing can be fitted into the gap 151.

As shown in FIG. 11, a retainer inserting port 132 is opened in one side surface 131 of the hood portion 130. The one side surface 131 is the one side surface 111 of the first connector housing 110. The retainer inserting port 132 is an opening for inserting the retainer 200. The retainer inserting port 132 pierces one side wall portion 134 in the connector width direction X1. The side wall portion 134 provides the side surface 131 of the hood portion 130.

In addition, the retainer inserting portion 123 of the aforementioned terminal receiving portion 120 is provided in a position opposed to the retainer inserting port 132 of the hood portion 130.

As soon as fitting between the first connector housing 110 and the partner connector housing is completed, the lock arm 140 is engaged with a lock protrusion of the partner connector housing to thereby lock the connection state between the connector housings.

The retainer 200 is inserted in the connector width direction X1 into the first connector housing 110 from the aforementioned retainer inserting port 132.

As shown in FIGS. 10 and 11, the retainer 200 includes housing lock arms 210, the temporary lock lances 220, the terminal lock portions 230, and a support portion 240.

The housing lock arms 210 are arms extending in the connector width direction X1 from upper and lower end portions of the support portion 240. Each of the housing lock arms 210 is shaped like a single-end supported beam which has a distal end as a free end, and a proximal end supported by the support portion 240. In the housing lock arm 210, a lock protrusion 211 (see FIG. 11) protruded inward is engaged with the temporary lock portion or the regular lock portion of an outer circumferential surface of the terminal receiving portion 120 to thereby position the retainer 200 in the temporary lock position or the regular lock position.

When the retainer 200 is positioned in the temporary lock position, the temporary lock lances 220 provided in the retainer 200 reach positions facing the terminal receiving holes 121 to be thereby engaged with the terminal metal fittings inserted through the terminal receiving holes 121. Thus, the terminal metal fittings are prevented from dropping off. The temporary lock lances 220 allow the terminal metal fittings to be inserted into the terminal receiving holes 121. When the temporary lock lances 220 are engaged with the terminal metal fittings inserted into the terminal receiving holes 121, the terminal metal fittings are prevented from dropping off.

When the retainer 200 is positioned in the regular lock position, the terminal lock portions 230 provided in the retainer 200 protrude into the terminal receiving holes 121 to be thereby engaged with the terminal metal fittings locked by the temporary lock lances 220. Thus, the terminal metal fittings are fixed.

The support portion 240 is provided on the proximal end side of the retainer 200. The support portion 240 is a support portion which supports the housing lock arms 210, the temporary lock lances 220 and the terminal lock portions 230.

SUMMARY OF THE INVENTION

In the connector 100, assume that the retainer 200 is inclined with respect to the original insertion direction (connector width direction X1) when the retainer 200 is inserted into the retainer inserting port 132 of the first connector housing 110. In this case, the distal ends of the housing lock arms 210 abut against the outer circumferential surface of the terminal receiving portion 120 to thereby cause deflection/deformation in the housing lock arms 210. In the connector 100, the support structure of each of the housing lock arms 210 is shaped like a single-end supported beam. Accordingly, there is a fear that the distal end of the housing lock arm 210 may be deflected easily and the distal end of the housing lock arm 210 colliding against the terminal receiving portion 120 may be deflected largely to thereby cause damage to the housing lock arm 210.

An object of the present invention is to provide a connector in which a housing lock arm of a retainer can be suppressed from being damaged due to its collision against a structure portion inside a first connector housing when the retainer is inserted into the housing.

The above-described object may be achieved by the following configurations.

(1) A connector including: a first connector housing which includes: a terminal receiving portion; and a hood portion which is formed to have a cylindrical structure which surrounds the terminal receiving portion to define a gap around the terminal receiving portion such that a cylindrical portion of a second connector housing is allowed to be fitted into the gap in a fitting direction; and a retainer which is inserted, in an insertion direction perpendicular to the fitting direction, into the first connector housing from a retainer inserting port opened in one side surface of the first connector housing, and which includes: a housing lock arm which is engaged with a lock protrusion provided in the first connector housing to position the retainer in a temporary lock position and a regular lock position when the retainer is inserted into the first connector housing; and a terminal lock portion which is engaged with a terminal metal fitting provided in the terminal receiving portion to prevent the terminal metal fitting from dropping off when the retainer is positioned in the regular lock position, wherein the retainer includes an arm support portion which supports both ends of the housing lock arm extending in the insertion direction.

(2) The connector according to the configuration (1), wherein the housing lock arm includes a housing lock portion which is engaged with the lock protrusion provided in the first connector housing such that the housing lock portion engaged with the lock protrusion is flexibly deformed in the fitting direction.

(3) The connector according to the above-described configuration (1) or (2), further including: a cylindrical packing which is outer-fitted to the terminal receiving portion of the first connector housing, wherein the retainer includes a packing holding portion which opposes an end portion of the packing from a front end side of the terminal receiving portion to restrict the packing from moving in a detachment direction.

According to the aforementioned configuration (1), the support structure of the housing lock arm of the retainer inserted into the first connector housing is a double-end supported beam-like structure having its both ends supported. Therefore, deflection/deformation hardly occurs in the distal end of the housing lock arm and strength of the housing lock arm is improved, in comparison with the case of a single-end supported beam-like support structure. Accordingly, when the retainer is inserted into the first connector housing, the distal end of the housing lock arm can be suppressed from being deformed due to its collision against a region inside the first connector housing. Thus, the housing lock arm can be suppressed from being damaged.

According to the aforementioned configuration (2), the housing lock arm of the retainer is provided with the housing lock portion which is engaged with the lock protrusion inside the first connector housing so that the housing lock portion engaged with the lock protrusion can be deflected/deformed in a fitting direction between the connector housings. Accordingly, it will go well as long as an escape space for allowing deflection of the housing lock arm is provided in the fitting direction between the connector housings. That is, since the escape space for allowing deflection of the housing lock arm does not have to be provided in a height direction of the housing perpendicular to the fitting direction between the connector housings, the height of the connector can be reduced.

According to the aforementioned configuration (3), when the retainer is mounted in the first connector housing after the packing is mounted in the terminal receiving portion of the first connector housing, the packing holding portions provided in the retainer restrict the packing from moving in a detachment direction. Therefore, as long as the retainer is mounted in advance, the packing can be prevented from being detached during storage or during transportation.

According to the connector according to aspects of the present invention, the housing lock arm of the retainer can be suppressed from being damaged due to its collision against the structure portion inside the first connector housing when the retainer is inserted into the housing.

The present invention has been described above briefly. By reading the following embodiments of the present invention with reference to the accompanying drawings, details of the invention can be made further clear.

DETAILED DESCRIPTION OF THE EXEMPLARY EMBODIMENTS

A connector according to an embodiment of the present invention will be described below in detail with reference to the drawings.

Figure 1:
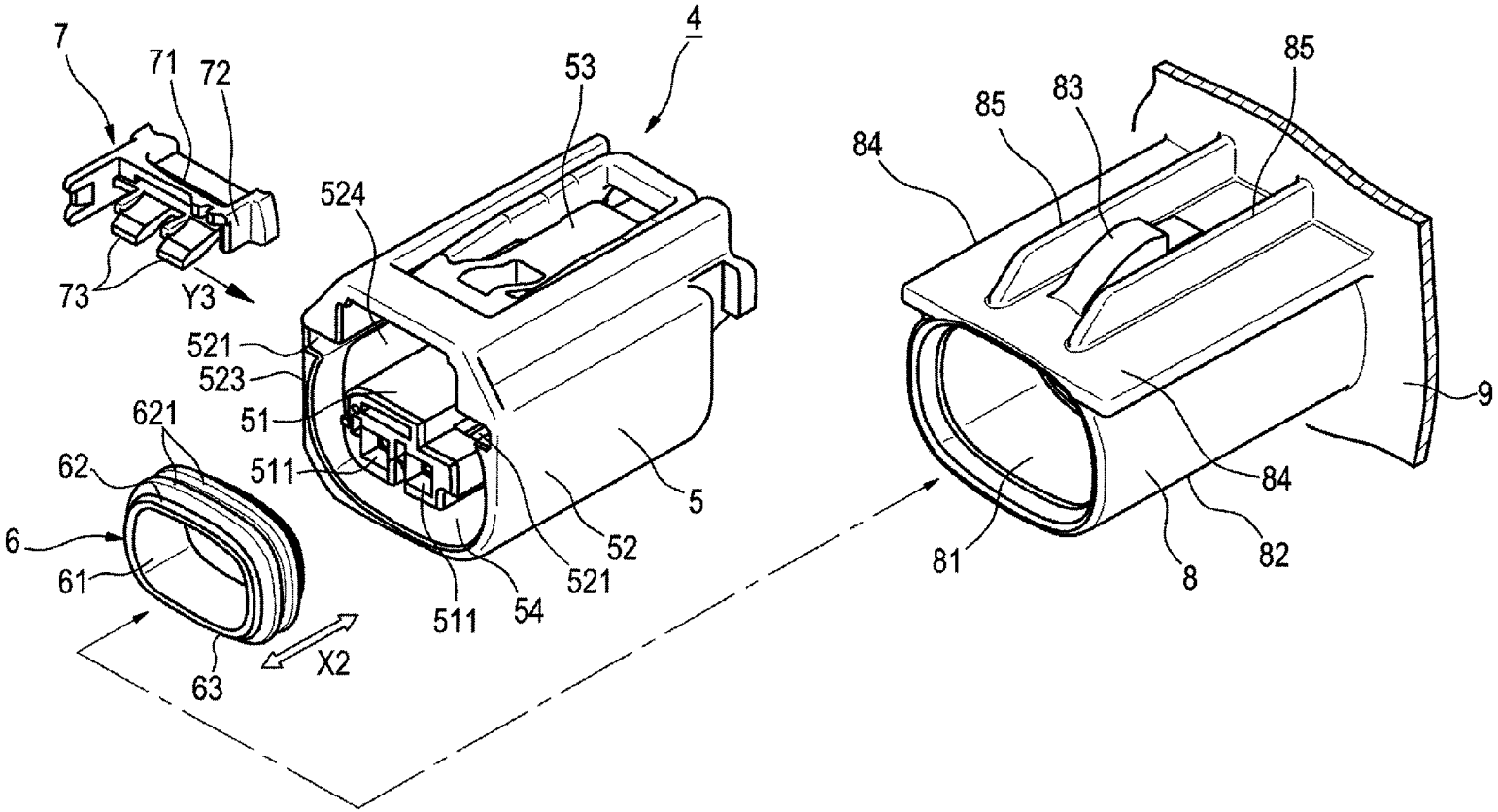
FIG. 1 is an exploded perspective view of an embodiment of a connector according to the invention.
Figure 2:
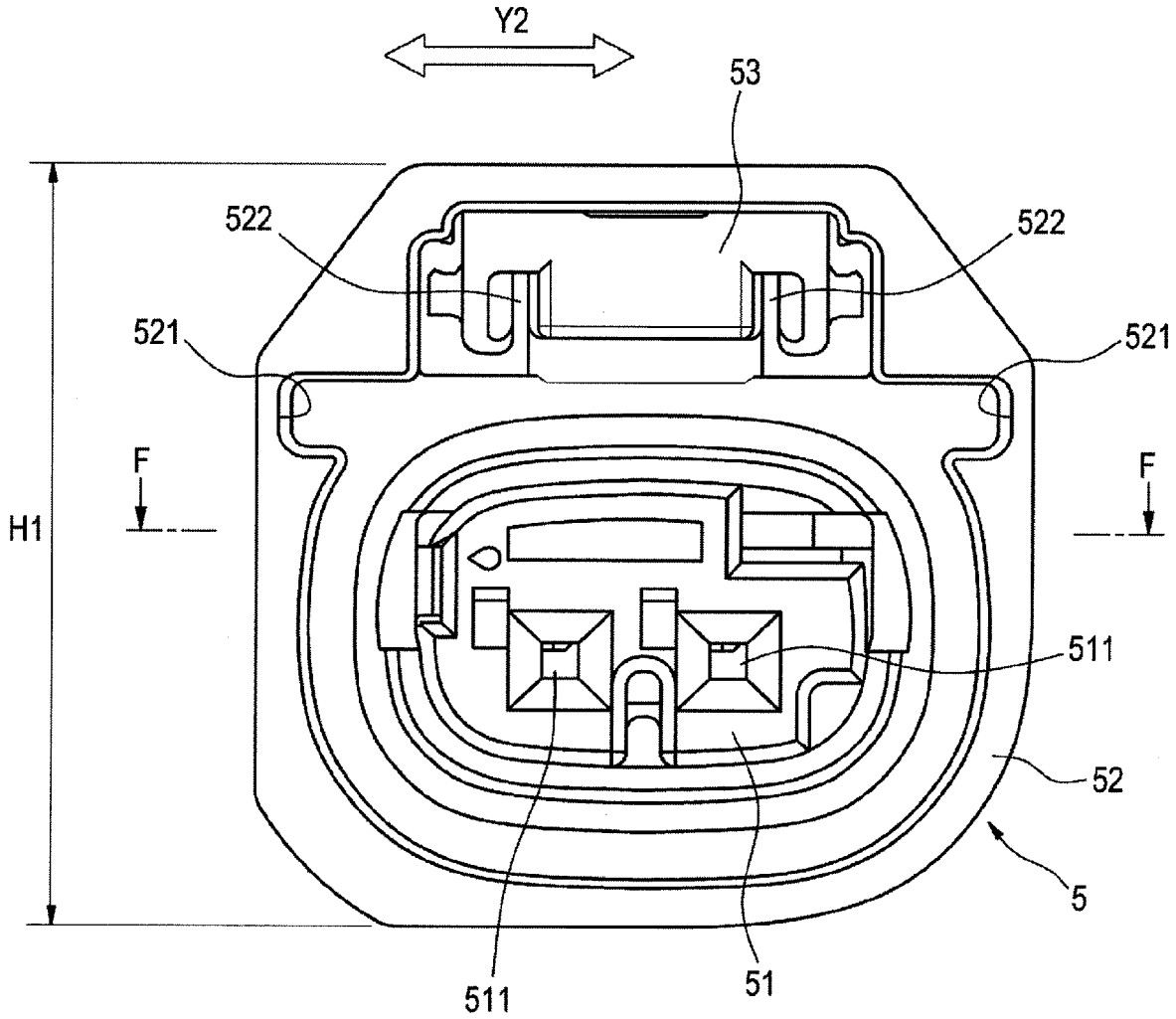
FIG. 2 is a front view of a first connector housing shown in FIG. 1.
Figure 3:
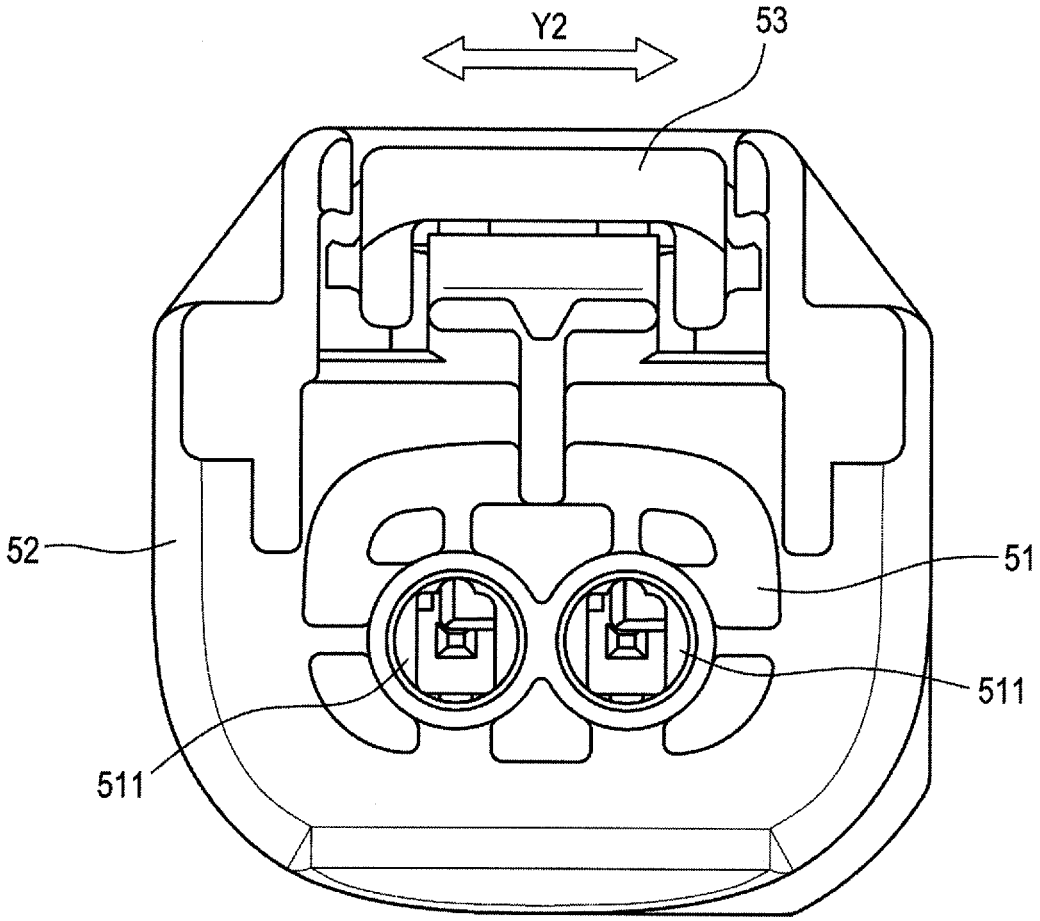
FIG. 3 is a back view of the first connector housing shown in FIG. 1.
Figure 4:
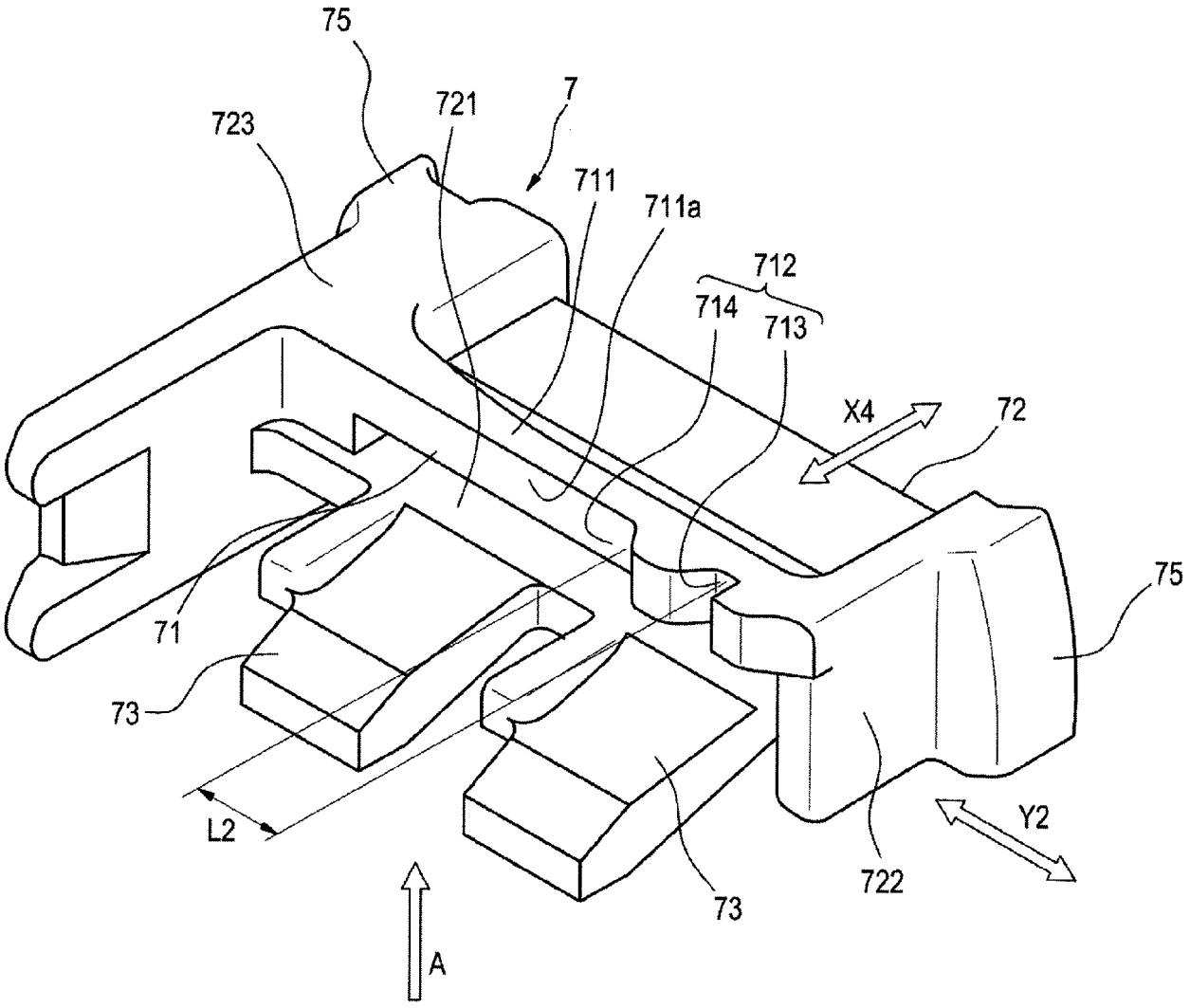
FIG. 4 is an enlarged perspective view of a retainer shown in FIG. 1.
Figure 5:
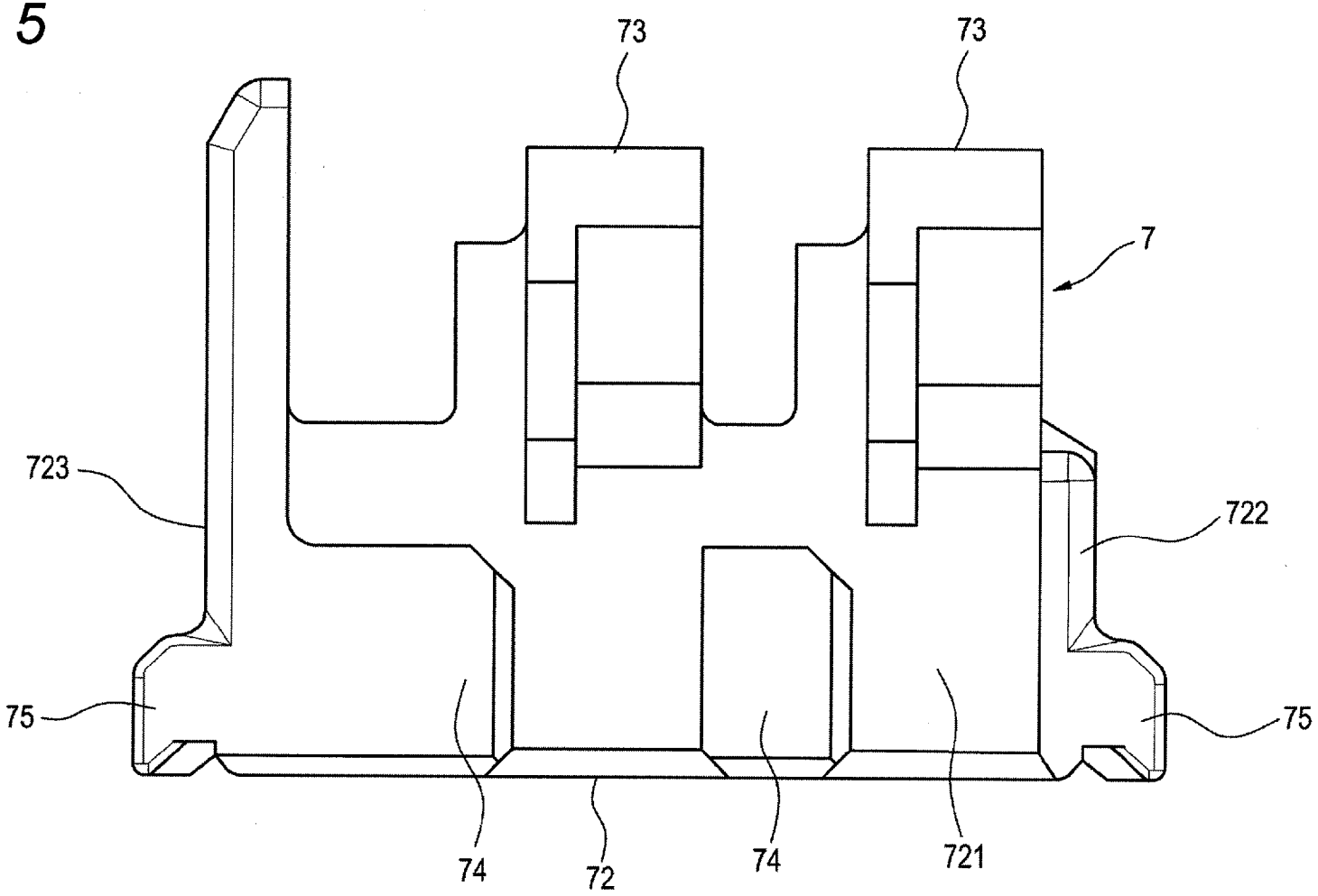
FIG. 5 is a view of the retainer shown in FIG. 4 as observed in the direction of an arrow A.
Figure 6:
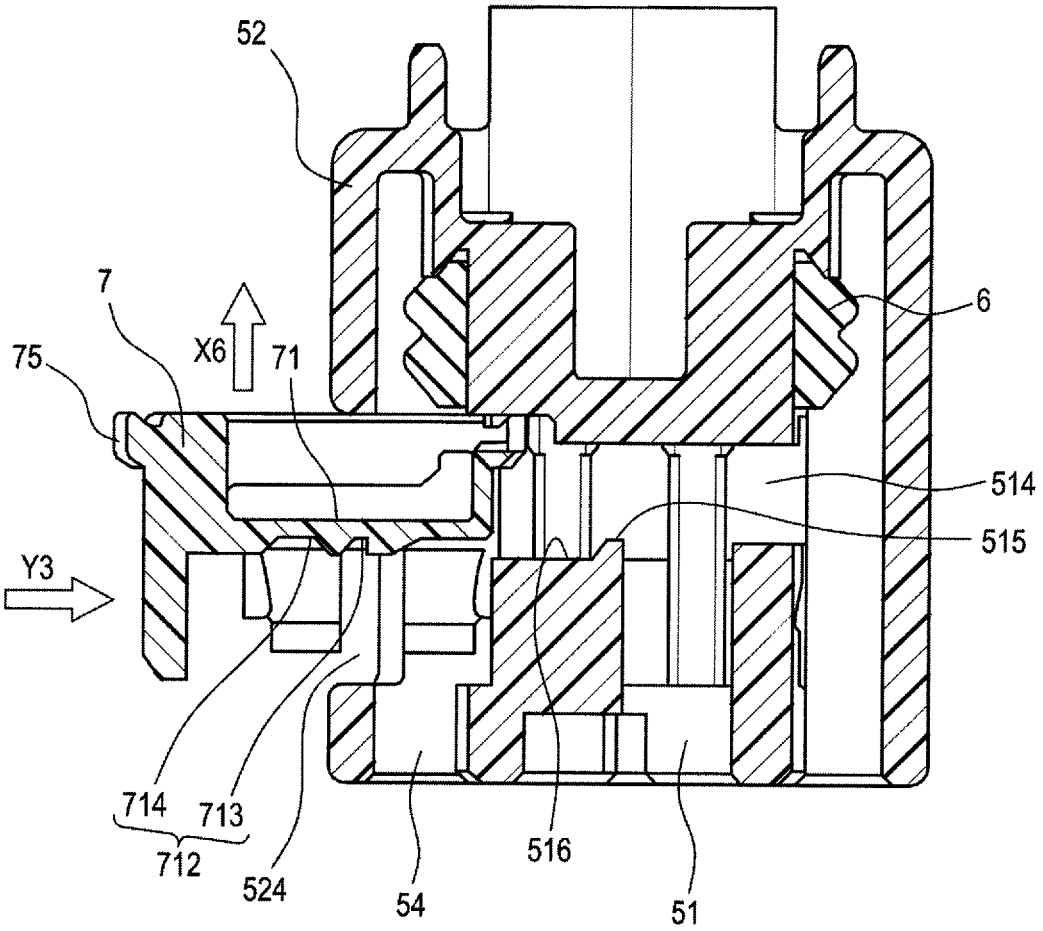
FIG. 6 is a horizontal sectional view showing a state in a start time for mounting the retainer in the first connector housing shown in FIG. 1.
Figure 7:
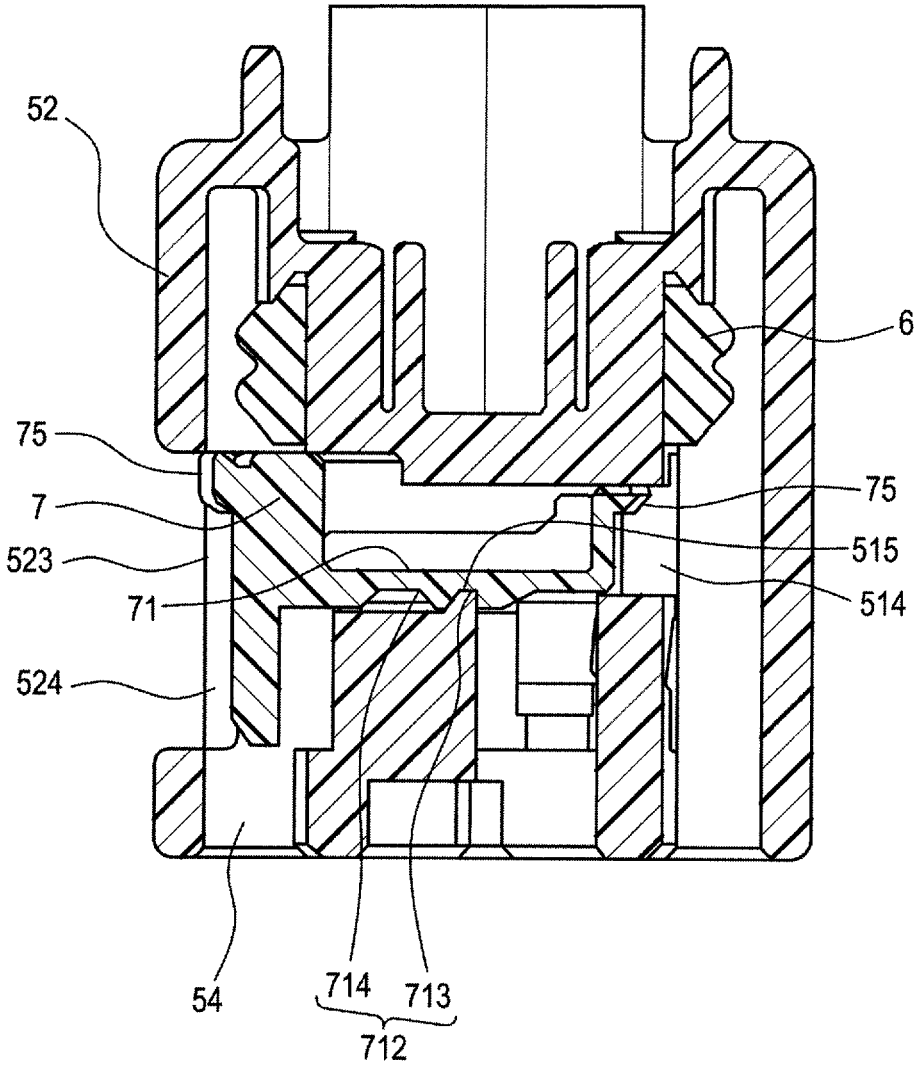
FIG. 7 is a horizontal sectional view showing a state in the middle of mounting the retainer in the first connector housing shown in FIG. 1.
Figure 8:
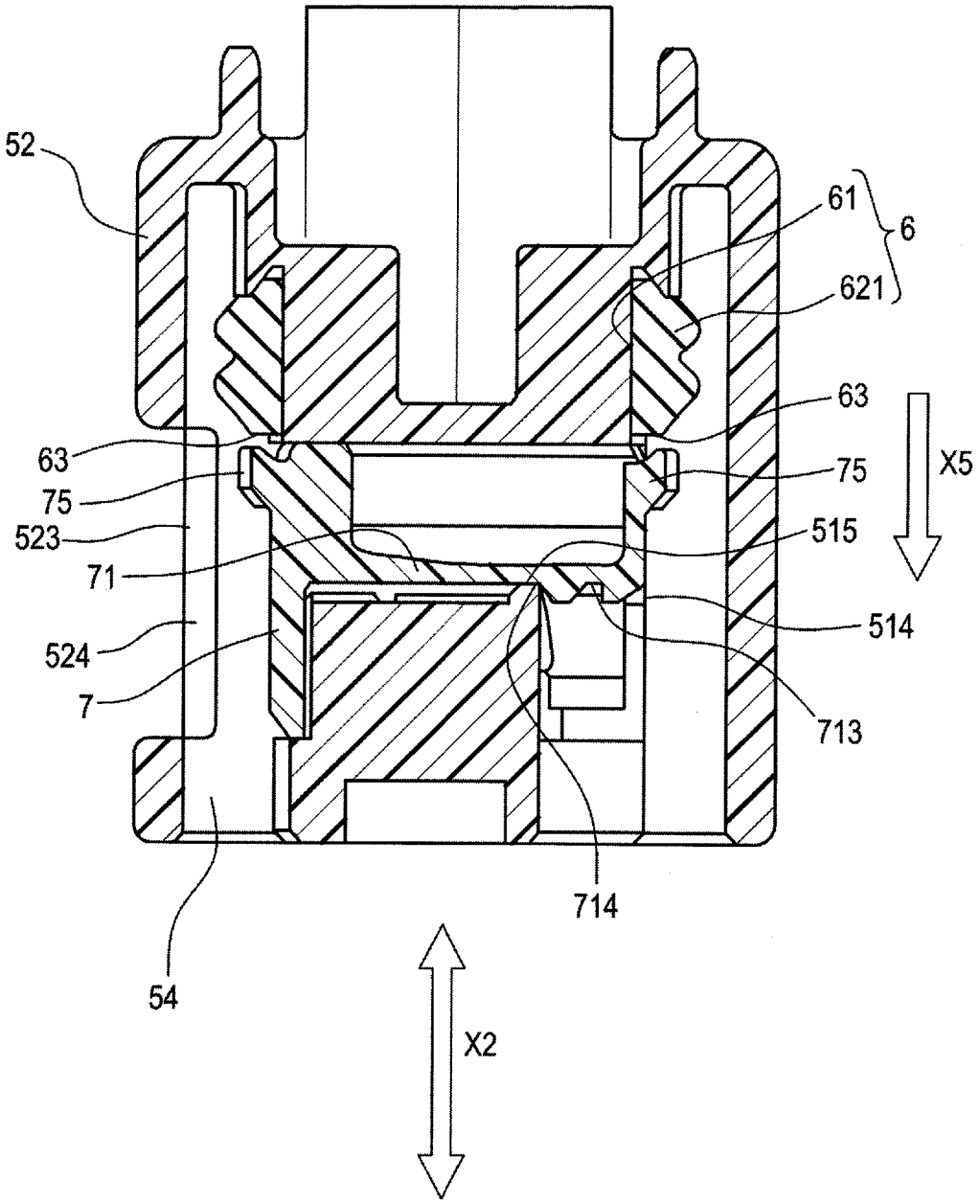
FIG. 8 is a horizontal sectional view showing a state in a completion time for mounting the retainer in the first connector housing shown in FIG. 1.
Figure 9:
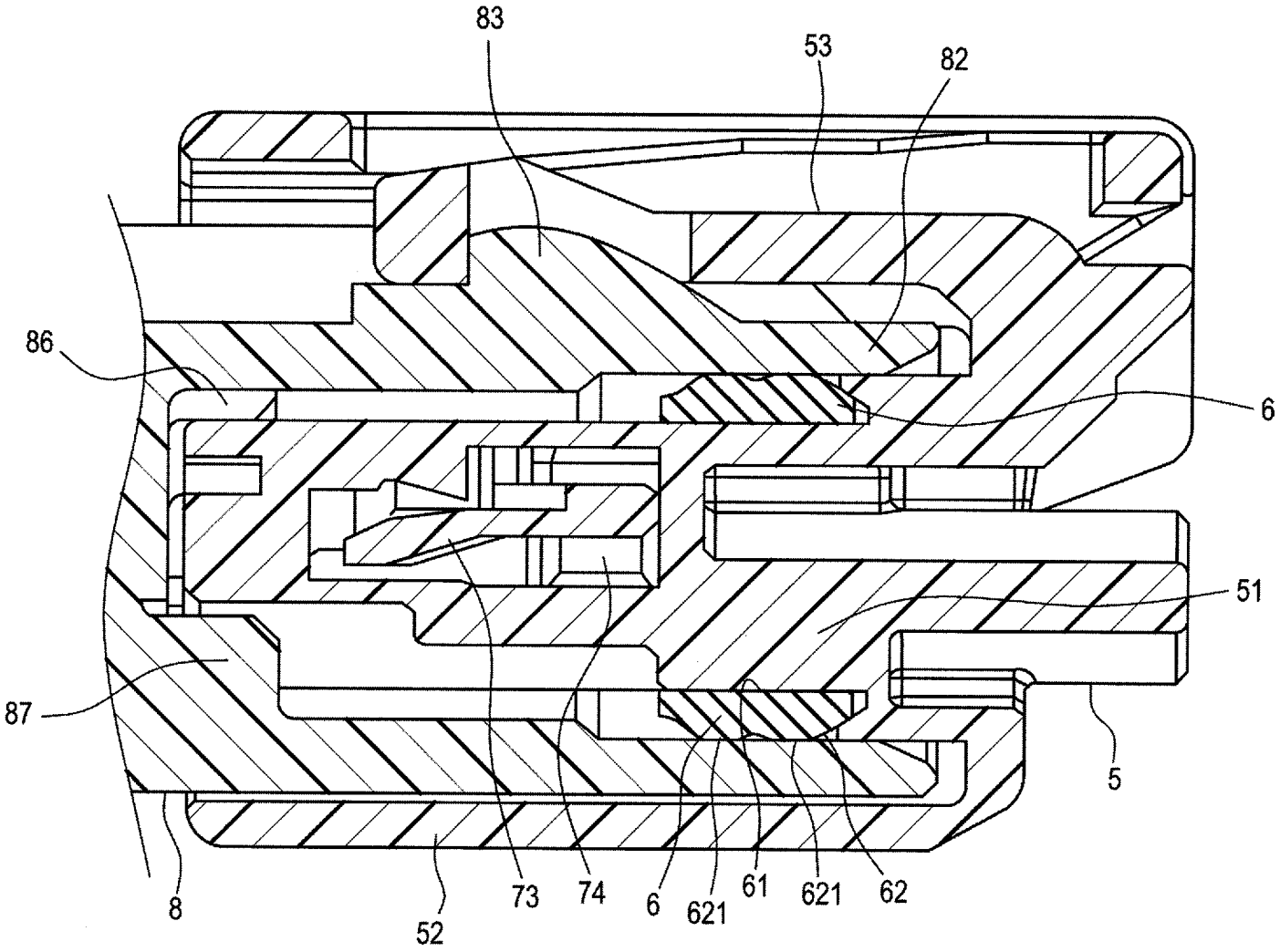
FIG. 9 is a sectional view of the connector shown in FIG. 1.
Figure 10:
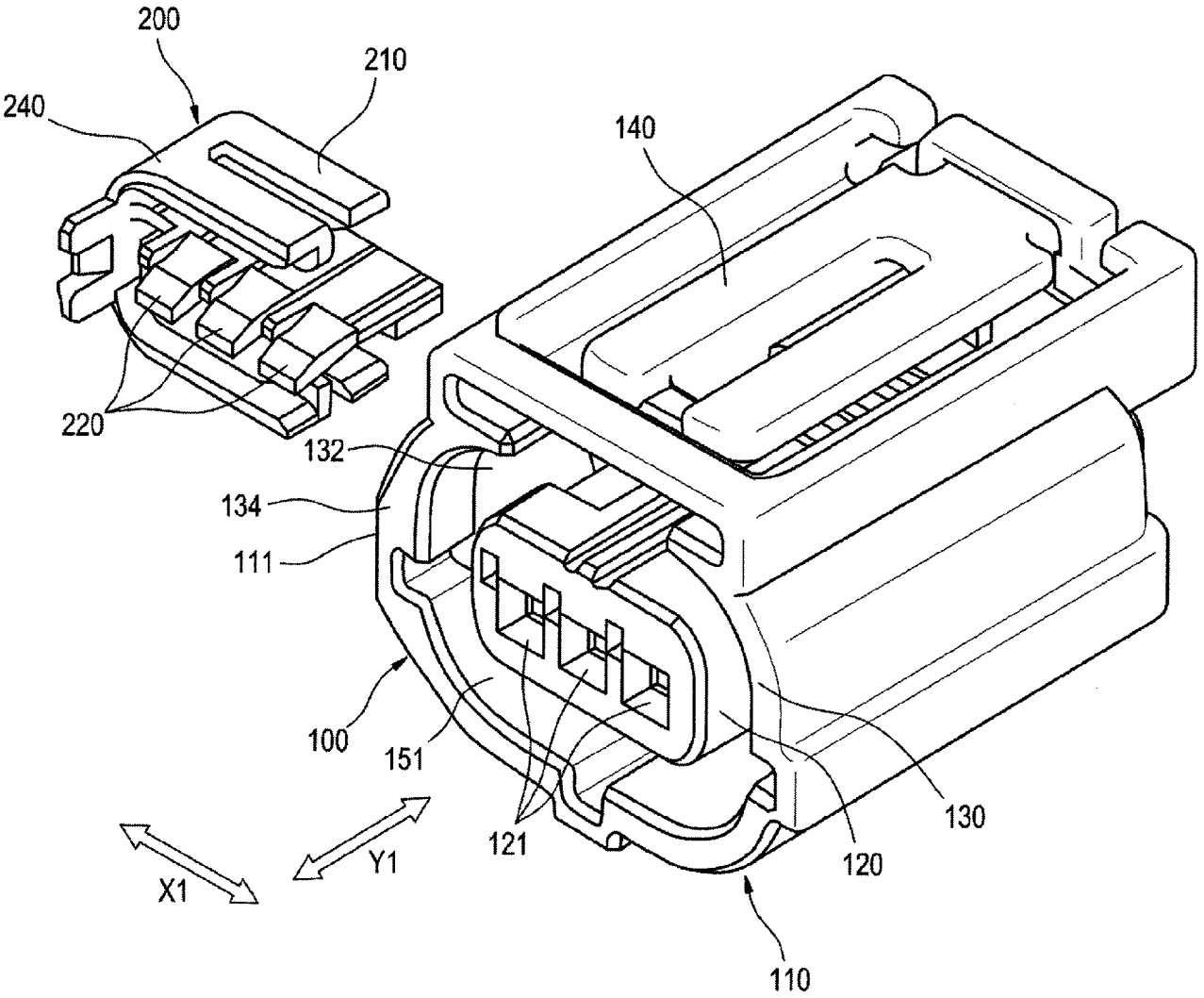
FIG. 10 is a perspective view of a connector according to the background art.
Figure 11:
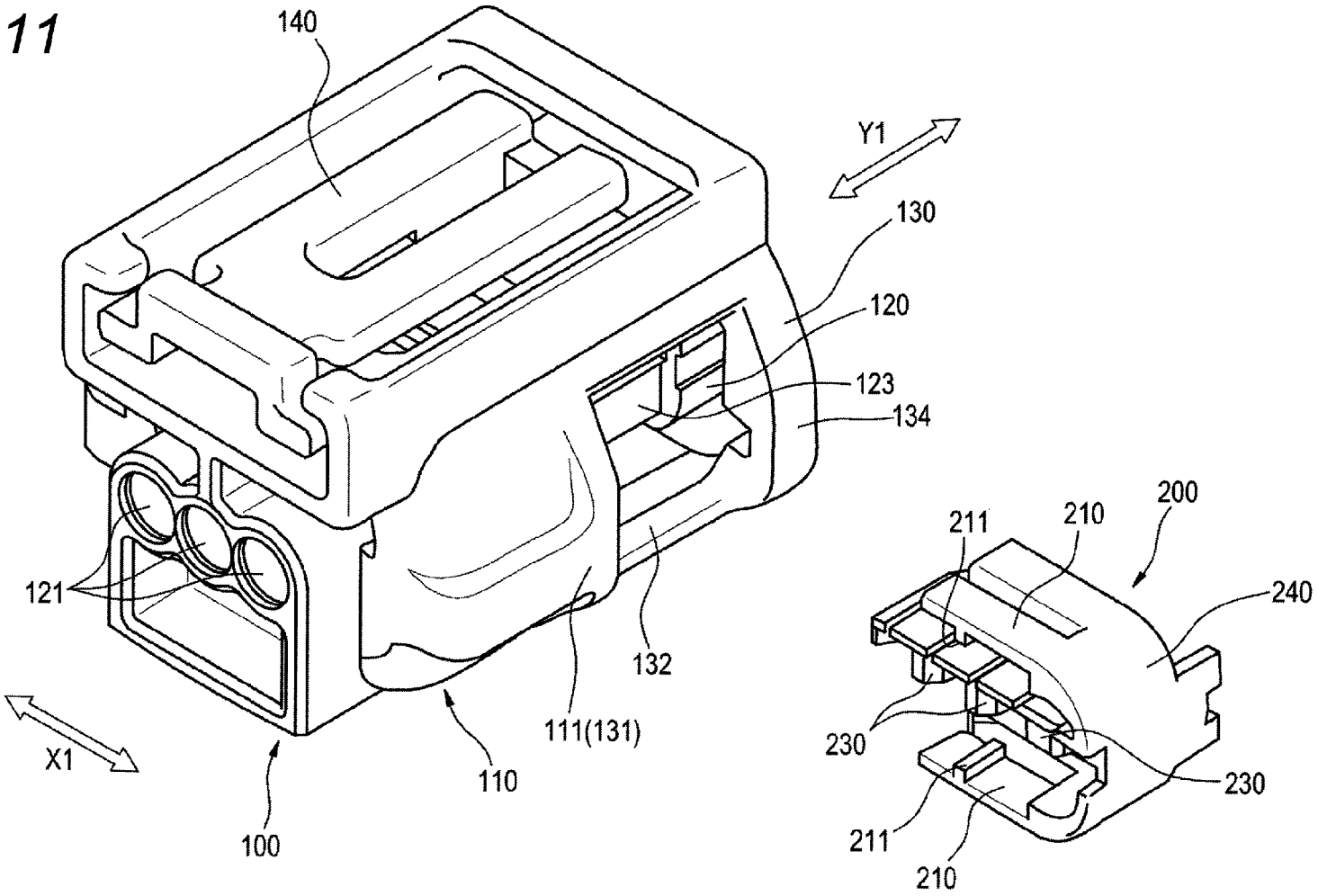
FIG. 11 is a perspective view of the connector shown in FIG. 10 as observed from another angle.

FIGS. 1 to 9 show an embodiment of a connector according to the invention. FIG. 1 is an exploded perspective view of the embodiment of the connector according to the invention. FIG. 2 is a front view of a first connector housing shown in FIG. 1. FIG. 3 is a back view of the first connector housing shown in FIG. 1. FIG. 4 is an enlarged perspective view of a retainer shown in FIG. 1. FIG. 5 is a view of the retainer shown in FIG. 4 as observed in the direction of an arrow A. FIG. 6 is a horizontal sectional view showing a state in a start time for mounting the retainer in the first connector housing shown in FIG. 1. FIG. 7 is a horizontal sectional view showing a state in the middle of mounting the retainer in the first connector housing shown in FIG. 1. FIG. 8 is a horizontal sectional view showing a state in a completion time for mounting the retainer in the first connector housing shown in FIG. 1. FIG. 9 is a sectional view of the connector shown in FIG. 1.

The connector 4 according to the embodiment is a waterproof connector. As shown in FIG. 1, the connector 4 includes a first connector housing 5, a packing 6, a retainer 7, and a second connector housing 8. The packing 6 shaped like a cylinder is fitted to and mounted in a terminal receiving portion 51 of the first connector housing 5 which will be described later. The retainer 7 is inserted into the first connector housing 5 from one side surface of the first connector housing 5. The second connector housing 8 is a connection partner of the first connector housing 5.

The first connector housing 5 is integrally formed out of a resin material. The first connector housing 5 includes the terminal receiving portion 51, a hood portion 52, and a lock arm 53. The terminal receiving portion 51 receives not-shown first terminal metal fittings. The hood portion 52 is formed into a cylindrical structure surrounding the terminal receiving portion 51. The lock arm 53 is formed integrally with the terminal receiving portion 51.

The terminal receiving portion 51 is a region which is substantially formed into a columnar shape extending in a fitting direction to the second connector housing 8 (direction of an arrow X2 in FIG. 1 and FIG. 8). As shown in FIG. 2 and FIG. 3, a plurality of (two in the illustrated example) terminal receiving holes 511 are arranged in a row in a connector width direction Y2 in the terminal receiving portion 51. Each of the terminal receiving holes 511 is a hole receiving the not-shown first terminal metal fitting (female terminal metal fitting). The terminal receiving hole 511 extends in the fitting direction X2 to the second connector housing 8.

In addition, the terminal receiving portion 51 includes a retainer inserting portion 514 and a retainer lock portion 515, as shown in FIGS. 6 to 8. Incidentally, the section of the first connector housing 5 shown in FIGS. 6 to 8 is a section taken along a line F-F of FIG. 2.

As shown in FIGS. 6 to 8, the retainer inserting portion 514 is a hole portion through which a housing lock arm 71, temporary lock lances 73, and terminal lock portions 74 of the retainer 7 which will be described later are inserted. The retainer inserting portion 514 is formed to pierce in the connector width direction Y2 and located in a position opposed to a retainer inserting port 524 formed in the hood portion 52 which will be described later.

As shown in FIG. 6, the retainer lock portion 515 is a lock protrusion which is provided protrusively on an inner wall surface 516 of the retainer inserting portion 514 positioned on a front end side of the first connector housing 5. When the retainer 7 inserted into the retainer inserting portion 514 reaches a temporary lock position, the retainer lock portion 515 is engaged with a temporary lock housing lock portion 713 on the housing lock arm 71 of the retainer 7 to thereby lock the retainer 7 in the temporary lock position. In addition, when the retainer 7 inserted into the retainer inserting portion 514 reaches a regular lock position, the retainer lock portion 515 is engaged with a regular lock housing lock portion 714 on the housing lock arm 71 of the retainer 7 to thereby lock the retainer 7 in the regular lock position.

That is, the retainer lock portion 515 in the embodiment functions as a retainer temporary lock portion locking the retainer 7 in the temporary lock position, and also functions as a retainer regular lock portion locking the retainer 7 in the regular lock position.

As shown in FIG. 1 and FIG. 6, the hood portion 52 defines a gap 54 surrounding the terminal receiving portion 51 so that a cylindrical portion 82 of the second connector housing 8 which will be described later can be fitted into the gap 54. The hood portion 52 is fitted to an outer circumference of the cylindrical portion 82 of the second connector housing 8 fitted into the gap 54. As shown in FIG. 1, the hood portion 52 according to the embodiment includes horizontal guide grooves 521 and vertical guide grooves 522 (see FIG. 2). Horizontal guide ribs 84 of the second connector housing 8 which will be described later are fitted into the horizontal guide grooves 521 slidably. Vertical guide ribs 85 of the second connector housing 8 which will be described later are fitted into the vertical guide groove 522 slidably.

When the first connector housing 5 and the second connector housing 8 are operated to be fitted to each other, the horizontal guide ribs 84 and the vertical guide ribs 85 of the second connector housing 8 which will be described later are fitted into the horizontal guide grooves 521 and the vertical guide grooves 522 provided in the hood portion 52. In this manner, a direction of moving the first connector housing 5 and the second connector housing 8 relatively to each other is restricted to prevent one of the connector housings from being inclined. Thus, torsion is prevented from occurring.

In the first connector housing 5 according to the embodiment, the retainer inserting port 524 is formed to pierce one side surface 523 of the hood portion 52, as shown in FIG. 1 and FIG. 6. The retainer inserting port 524 is an opening for inserting the retainer 7. The retainer inserting port 524 is provided in a position opposed to the retainer inserting portion 514 of the terminal receiving portion 51 shown in FIG. 6. Thus, the housing lock arm 71, the temporary lock lances 73 and the terminal lock portions 74 of the retainer 7 inserted into the retainer inserting port 524 can be inserted through the retainer inserting portion 514.

Assume that a fitting length between the cylindrical portion 82 of the second connector housing 8 and the terminal receiving portion 51 reaches a predetermined value so that fitting between the first connector housing 5 and the second connector housing 8 is completed, as shown in FIG. 9. In this case, the lock arm 53 is engaged with a lock protrusion 83 on the second connector housing 8 to thereby lock the fitting state between the first connector housing 5 and the second connector housing 8.

The lock arm 53 according to the embodiment is formed integrally with the terminal receiving portion 51 so that when the cylindrical portion 82 of the second connector housing 8 is fitted to an inner side of the hood portion 52, a free end side of the lock arm 53 can be deflected/deformed in a direction perpendicular to an upper surface of the cylindrical portion 82 of the second connector housing 8.

The packing 6 is shaped like a cylinder which is outer-fitted to the terminal receiving portion 51 of the first connector housing 5. The packing 6 is integrally molded out of synthetic rubber or natural rubber having moderate elasticity.

As shown in FIG. 9, an inner circumferential surface 61 of the packing 6 is a smooth surface which makes tight contact with an outer circumferential surface of the terminal receiving portion 51. In addition, two annular protrusions (rib portions) 621 are provided in an outer circumferential surface 62 of the packing 6 so that the two annular protrusions 621 can make tight contact with an inner circumference of the cylindrical portion 82 of the second connector housing 8. As shown in FIG. 9, the inner circumferential surface 61 of the packing 6 is brought into tight contact with the outer circumferential surface of the terminal receiving portion 51 and the annular protrusions 621 of the outer circumferential surface 62 are brought into tight contact with the inner circumferential surface of the cylindrical portion 82. Thus, waterproofness inside the housing can be secured.

As shown in FIG. 6, the retainer 7 is inserted in the connector width direction Y2 into the first connector housing 5 from the retainer inserting port 524 opened in one side surface of the first connector housing 5. An arrow Y3 in FIG. 1 and FIG. 6 indicates an insertion direction of the retainer 7.

The retainer 7 according to the embodiment is an integrally molded article made of a resin. As shown in FIG. 4 and FIG. 5, the retainer 7 includes the housing lock arm 71, an arm support portion 72, the temporary lock lances 73, the terminal lock portions 74, and packing holding portions 75.

The housing lock arm 71 includes an arm body 711 and a housing lock portion 712. The arm body 711 is shaped like a rod extending in the insertion direction (connector width direction Y2) into the retainer inserting portion 514 of the terminal receiving portion 51. The housing lock portion 712 is formed on the arm body 711.

As shown in FIG. 4, the housing lock portion 712 includes a temporary lock housing lock portion 713 and a regular lock housing lock portion 714.

Assume that the housing lock arm 71 is inserted into the retainer inserting portion 514 so that the retainer 7 reaches the temporary lock position, as shown in FIG. 7. In this case, the temporary lock housing lock portion 713 is engaged with the retainer lock portion (lock protrusion) 515 inside the retainer inserting portion 514 to thereby position (temporarily fix) the retainer 7 in the temporary lock position (position shown in FIG. 7).

Assume that the housing lock arm 71 is inserted into the retainer inserting portion 514 so that the retainer 7 reaches the regular lock position, as shown in FIG. 8. In this case, the regular lock housing lock portion 714 is engaged with the retainer lock portion (lock protrusion) 515 inside the retainer inserting portion 514 to thereby position the retainer 7 in the regular lock position (position shown in FIG. 8).

That is, when the retainer 7 is inserted into the retainer inserting portion 514 inside the first connector housing 5, the temporary lock housing lock portion 713 or the regular lock housing lock portion 714 of the housing lock arm 71 is engaged with the retainer lock portion 515 to thereby position the retainer 7 in the temporary lock position or the regular lock position.

In addition, the housing lock arm 71 is provided with the housing lock portion 712 in a front end face 711a of the arm body 711 so that the housing lock portion 712 can be deflected/deformed in the fitting direction X2 (direction of an arrow X4 in FIG. 4) between the connector housings when the housing lock portion 712 is engaged with the retainer lock portion 515 inside the first connector housing 5. The front end face 711a of the arm body 711 is a face perpendicular to the fitting direction between the connector housings. The temporary lock housing lock portion 713 and the regular lock housing lock portion 714 constituting the housing lock portion 712 are provided on the front end face 711a and located in positions shifted by a distance L2 from each other in the insertion direction into the retainer inserting portion 514.

The arm support portion 72 includes a support portion body 721, and end portion supporting portions 722 and 723. The support portion body 721 is shaped like a rod extending in the insertion direction (connector width direction Y2) into the retainer inserting portion 514 and located in a position separated at a predetermined distance from the arm body 711 and on the lower side thereof. The end portion supporting portions 722 and 723 extend vertically upward from both ends of the support portion body 721 so as to connect the both ends of the support portion body 721 to both ends of the housing lock arm 711. The support portion body 721 extends in parallel with the arm body 711.

The arm support portion 72 according to the embodiment supports the both ends of the housing lock arm 71 by the paired end portion supporting portions 722 and 723.

That is, in the retainer 7 according to the embodiment, the support structure of the housing lock arm 71 is a double-end supported beam-like support structure in which the both ends of the housing lock arm 71 separated from each other in the insertion direction into the retainer inserting portion 514 are supported by the end portion supporting portions 722 and 723.

The temporary lock lances 73 are elastic lock pieces which extend from the support portion body 721 and in the fitting direction between the connector housings. When the retainer 7 is positioned in the temporary lock position, the temporary lock lances 73 are positioned in positions facing the terminal receiving holes 511 so that the temporary lock lances 73 can prevent the terminal metal fittings inserted into the terminal receiving holes 511 from dropping off. The temporary lock lances 73 allow the terminal metal fittings to be inserted into the terminal receiving holes 511 so that the temporary lock lances 73 can be engaged with the terminal metal fittings inserted into the terminal receiving holes 511. Thus, the terminal metal fittings are prevented from dropping off.

As shown in FIG. 5, the terminal lock portions 74 are protrusions which are formed to bulge in a lower surface of the support portion body 721. When the retainer 7 is positioned in the regular lock position, the terminal lock portions 74 protrude into the terminal receiving holes 511 to be engaged with the terminal metal fittings which have been temporarily locked by the temporary lock lances 73. Thus, the terminal metal fittings are prevented from dropping off. In the state in which the terminal lock portions 74 protrude into the terminal receiving holes 511, the terminal metal fittings cannot be inserted into the terminal receiving holes 511.

As shown in FIG. 4 and FIG. 6, the packing holding portions 75 are regions protruding in the connector width direction from outer side faces of the end portion supporting portions 722 and 723 of the retainer 7. As shown in FIG. 8, in the state in which the retainer 7 reaches the regular lock position inside the first connector housing 5, the packing holding portions 75 are opposed to an end portion 63 of the packing 6 from the front end side of the terminal receiving portion 51 to thereby restrict the packing 6 from moving in a detachment direction (direction of an arrow X5 in FIG. 8).

The second connector housing 8 is a housing which is fixedly provided in a housing 9 of an apparatus etc. The second connector housing 8 is an integrally molded article made of a resin. As shown in FIG. 1, the second connector housing 8 includes a terminal array space 81, the cylindrical portion 82, the lock protrusion 83, the horizontal guide ribs 84 and the vertical guide ribs 85. Distal end portions of second terminal metal fittings protrude in the terminal array space 81.

The terminal array space 81 is a space in which the distal end portions of the second terminal metal fittings (not shown) protrude so that the second terminal metal fittings can be fitted to the first terminal metal fittings inside the terminal receiving portion 51.

The cylindrical portion 82 is shaped like a cylinder surrounding the terminal array space 81 so as to define the terminal array space 81. The cylindrical portion 82 is inserted into the gap 54 of the first connector housing 5 to be fitted to the outer circumference of the terminal receiving portion 51. On this occasion, the cylindrical portion 82 is fitted to the inner circumference of the hood portion 52. As shown in FIG. 9, the annular protrusions 621 of the packing 6 make tight contact with the inner circumferential surface of the cylindrical portion 82 outer-fitted to the terminal receiving portion 51. Thus, the gap between the cylindrical portion 82 and the terminal receiving portion 51 is sealed.

The lock protrusion 83 is a protrusion protrusively provided on the outer surface of the cylindrical portion 82. When the fitting length between the cylindrical portion 82 and the terminal receiving portion 51 reaches the predetermined value, the lock protrusion 83 is engaged with the lock arm 53 to thereby lock the connection state between the first connector housing 5 and the second connector housing 8, as shown in FIG. 9.

When the first connector housing 5 and the second connector housing 8 are fitted to each other, the horizontal guide ribs 84 are engaged with the horizontal guide grooves 521 of the first connector housing 5 slidably. Thus, occurrence of inclination between the housings is prevented.

When the first connector housing 5 and the second connector housing 8 are fitted to each other, the vertical guide ribs 85 are engaged with the vertical guide grooves 522 of the first connector housing 5 slidably. Thus, occurrence of inclination between the housings is prevented.

That is, in the first connector housing 5 and the second connector housing 8 according to the embodiment, the horizontal guide ribs 84 and the vertical guide ribs 85 of the second connector housing 8 are engaged with the horizontal guide grooves 521 and the vertical guide grooves 522 provided in the first connector housing 5. In this manner, a direction of moving the connector housings relatively to each other is restricted to thereby prevent occurrence of inclination from the fitting direction.

In the case of the configuration of the connector 4 according to the aforementioned embodiment, the support structure of the housing lock arm 71 of the retainer 7 inserted into the first connector housing 5 is a double-end supported beam-like structure having its both ends supported. Therefore, deflection/deformation hardly occurs in the distal end of the housing lock arm 71 and the strength of the housing lock arm 71 is improved, in comparison with the case of a single-end supported beam-like support structure. Assume that, for example, the retainer 7 is inclined to the direction of an arrow X6 in FIG. 6 when the retainer 7 is inserted into the first connector housing 5. In this case, the distal end side of the housing lock arm 71 in the retainer 7 may collide against a region such as a circumferential edge portion of the retainer inserting portion 514 inside the first connector housing 5. However, since the housing lock arm 71 has the double-end supported beam-like support structure high in strength, deformation of the distal end of the housing lock arm 71 can be suppressed so that damage to the housing lock arm 71 can be suppressed.

In addition, in the case of the configuration of the connector 4 according to the aforementioned embodiment, the housing lock arm 71 of the retainer 7 is provided with the housing lock portion 712 which is engaged with the retainer lock portion 515 serving as a lock protrusion inside the first connector housing 5 so that the housing lock portion 712 engaged with the retainer lock portion 515 can be deflected/deformed in the fitting direction X2 between the connector housings, as shown in FIG. 7 and FIG. 8. Accordingly, it will go well as long as an escape space for allowing deflection of the housing lock arm 71 is provided in the fitting direction X2 between the connector housings. That is, since the escape space for allowing deflection of the housing lock arm 71 does not have to be provided in a height direction of the housing perpendicular to the fitting direction X2 between the connector housings, the increase of a dimension H1 in the height direction of the first connector housing 5 can be suppressed so that reduction of the height of the connector 4 can be achieved.

Further, in the case of the configuration of the connector 4 according to the aforementioned embodiment, when the retainer 7 is mounted in the first connector housing 5 after the packing 6 is mounted in the terminal receiving portion 51 of the first connector housing 5, as shown in FIG. 8, the packing holding portions 75 provided in the retainer 7 are opposed to the end portion 63 of the packing 6 to restrict the packing 6 from moving in the detachment direction. Therefore, as long as the retainer 7 is mounted in advance, the packing 6 can be prevented from being detached during storage or during transportation.

Incidentally, the invention is not limited to the aforementioned embodiment but modification, improvement, etc. may be made on the invention suitably. In addition thereto, the material, shape, dimensions, number, arrangement place, etc. of each constituent member in the aforementioned embodiment are not limited but may be set desirably as long as the invention can be achieved.

Here, the aforementioned characteristics of the embodiment of the connector according to the invention will be summarized and listed briefly in the following items [1] to [3] respectively.

[1] A connector (4) including:

a first connector housing (5) which includes: a terminal receiving portion (51); and a hood portion (52) which is formed to have a cylindrical structure which surrounds the terminal receiving portion (51) to define a gap (54) around the terminal receiving portion (51) such that a cylindrical portion (82) of a second connector housing (8) is allowed to be fitted into the gap (54) in a fitting direction; and a retainer (7) which is inserted, in an insertion direction perpendicular to the fitting direction, into the first connector housing (5) from a retainer inserting port (524) opened in one side surface of the first connector housing (5), and which includes: a housing lock arm (71) which is engaged with a lock protrusion (515) provided in the first connector housing (5) to position the retainer (7) in a temporary lock position and a regular lock position when the retainer (7) is inserted into the first connector housing (5); and a terminal lock portion (74) which is engaged with a terminal metal fitting provided in the terminal receiving portion (51) to prevent the terminal metal fitting from dropping off when the retainer (7) is positioned in the regular lock position, wherein the retainer (7) includes an arm support portion (72) which supports both ends of the housing lock arm (71) extending in the insertion direction.

[2] The connector (4) according to the above-described item [1], wherein the housing lock arm (71) includes a housing lock portion (712) which is engaged with the lock protrusion (515) provided in the first connector housing (5)

such that the housing lock portion (712) engaged with the lock protrusion (515) is flexibly deformed in the fitting direction (X2).

[3] The connector (4) according to the above-described item [1] or [2], further including:

a cylindrical packing (6) which is outer-fitted to the terminal receiving portion (51) of the first connector housing (5), wherein the retainer (7) includes a packing holding portion (75) which opposes an end portion of the packing (6) from a front end side of the terminal receiving portion (51) to restrict the packing (6) from moving in a detachment direction.

Although the invention has been described in detail and with reference to a specific embodiment, it is obvious to those skilled in the art that various changes or modifications may be added without departing from the spirit and scope of the invention.

According to embodiments of the present invention, it is possible to achieve an effect that the housing lock arm of the retainer can be prevented from being damaged due to its collision against the structure portion inside the connector housing when the retainer is inserted into the housing. The invention which can achieve the effect is useful for a connector in which terminal metal fittings inside a connector housing are prevented from dropping off by a retainer inserted into the connector housing from one side surface of the connector housing.

What is claimed is:

1. A connector comprising:

a first connector housing which comprises: a terminal receiving portion; and a hood portion which is formed to have a cylindrical structure which surrounds the terminal receiving portion to define a gap around the terminal receiving portion such that a cylindrical portion of a second connector housing is allowed to be fitted into the gap in a fitting direction; and a retainer which is inserted, in an insertion direction perpendicular to the fitting direction, into the first connector housing from a retainer inserting port opened in one side surface of the first connector housing, and which comprises: a housing lock arm which is engaged with a lock protrusion provided in the first connector housing to position the retainer in a temporary lock position and a regular lock position when the retainer is inserted into the first connector housing; and a terminal lock portion which is engaged with a terminal metal fitting provided in the terminal receiving portion to prevent the terminal metal fitting from dropping off when the retainer is positioned in the regular lock position, wherein the retainer comprises an arm support portion which supports both ends of the housing lock arm extending in the insertion direction.

2. The connector according to claim 1, wherein the housing lock arm comprises a housing lock portion which is engaged with the lock protrusion provided in the first connector housing such that the housing lock portion engaged with the lock protrusion is flexibly deformed in the fitting direction.

3. The connector according to claim 1, further comprising:

a cylindrical packing which is outer-fitted to the terminal receiving portion of the first connector housing, wherein the retainer comprises a packing holding portion which opposes an end portion of the packing from a front end side of the terminal receiving portion to restrict the packing from moving in a detachment direction.

* * * * *